US009951947B2

(12) United States Patent
Penski

(10) Patent No.: US 9,951,947 B2
(45) Date of Patent: Apr. 24, 2018

(54) INCINERATION GRATE CONSISTING OF GRATE BARS AND METHOD FOR FITTING GRATE BARS IN AND REMOVING SAME FROM AN INCINERATION GRATE

(71) Applicant: Dieffenbacher GmbH Maschinen- und Anlagenbau, Eppingen (DE)

(72) Inventor: Konstantin Penski, Sinsheim (DE)

(73) Assignee: DIEFFENBACHER GMBH MASCHINEN- UND ANLAGENBAU, Eppingen (DE)

( * ) Notice: Subject to any disclaimer, the term of this patent is extended or adjusted under 35 U.S.C. 154(b) by 940 days.

(21) Appl. No.: 14/353,748

(22) PCT Filed: Oct. 16, 2012

(86) PCT No.: PCT/EP2012/070520
§ 371 (c)(1),
(2) Date: Apr. 23, 2014

(87) PCT Pub. No.: WO2013/060605
PCT Pub. Date: May 2, 2013

(65) Prior Publication Data

US 2014/0283718 A1 Sep. 25, 2014

(30) Foreign Application Priority Data

Oct. 24, 2011 (DE) ..... 10 2011 085 137

(51) Int. Cl.
*F23H 7/08* (2006.01)
*F23H 17/02* (2006.01)

(52) U.S. Cl.
CPC ..... *F23H 7/08* (2013.01); *F23H 17/02* (2013.01); *Y10T 29/4973* (2015.01)

(58) Field of Classification Search
CPC ... F23H 7/08; F23H 13/00; F23H 1/02; F23H 3/04; F23H 17/12; F23H 7/18; F23H 11/12; F23G 5/002
(Continued)

(56) References Cited

U.S. PATENT DOCUMENTS 1,635,932 A * 7/1927 Fulweiler ..... F23H 13/00 126/163 R
1,906,228 A * 5/1933 Hulson ..... F23H 13/00 126/168
(Continued)

FOREIGN PATENT DOCUMENTS

DE 36 10 819 10/1987
FR 2758383 7/1998

OTHER PUBLICATIONS

International Search Report dated Jan. 16, 2013 issued in connection with International Application No. PCT/EP2012/070520, with English translation.

*Primary Examiner* — David J Laux
(74) *Attorney, Agent, or Firm* — Foley & Lardner LLP

(57) ABSTRACT

An incineration grate includes several levels including first and second grate bars arranged in rows alongside one another and in rows one above another, forming step-shaped combustion surfaces with their upper supporting surfaces. At least once in an area of the upper supporting surfaces, the first grate bars form, over their width, a smaller supporting surface for fuel than that of the second grate bars via a first shoulder disposed inwards in a direction of a longitudinal center plane. In an area of the upper supporting surfaces, the second grate bars have a supporting surface with a larger width in order to form an overlap with the first grate bars via a second shoulder disposed outwards over the width of the first grate bars. The second grate bars have at least one pin
(Continued)

Figure 1:
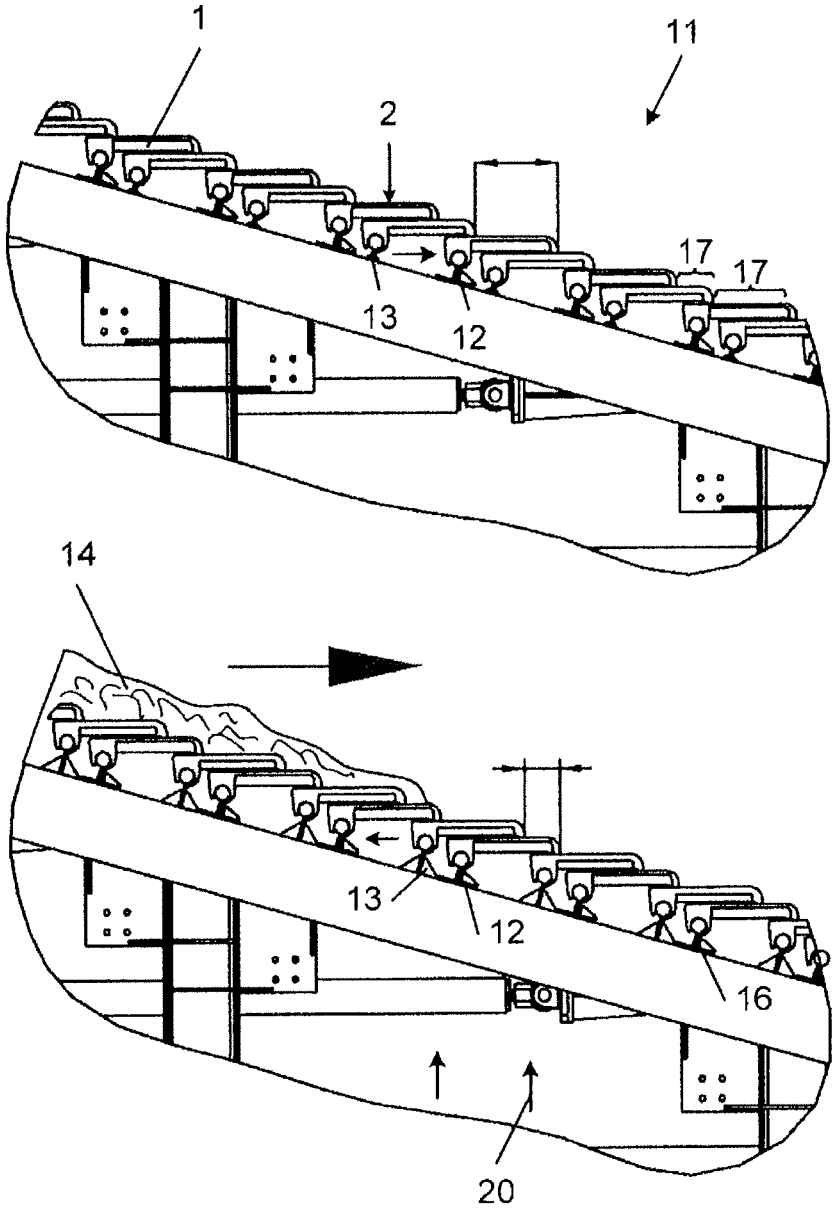

configured to be introduced into a pocket in the first grate bars and increase the larger width.

12 Claims, 6 Drawing Sheets

(58) Field of Classification Search
USPC ..... 110/281, 346; 126/163 R, 168
See application file for complete search history.

(56) References Cited

U.S. PATENT DOCUMENTS

| | | | | |
|---|---|---|---|---|
| 4,103,627 | A * | 8/1978 | Mainka | F23H 7/08 110/281 |
| 4,676,176 | A | 6/1987 | Bonomelli | |
| 2004/0261674 | A1 * | 12/2004 | Hepp | F23G 5/002 110/346 |

* cited by examiner

INCINERATION GRATE CONSISTING OF GRATE BARS AND METHOD FOR FITTING GRATE BARS IN AND REMOVING SAME FROM AN INCINERATION GRATE

CROSS REFERENCE TO RELATED APPLICATIONS

The present application is a U.S. National Stage of International Application No. PCT/EP2012/070520 filed on Oct. 16, 2012, which claims the benefit of German Patent Application No. 10 2011 085 137.2 filed on Oct. 24, 2011. The entire disclosures of which are incorporated herein by reference.

The invention relates to an incineration grate consisting of grate bars and a method for fitting grate bars in and removing same from an incineration grate.

In the course of manufacturing chipboard, plastic sheets or insulating sheets and/or mats in large industrial systems, generally thermal energy production systems are offered that incinerate the scrap from production and/or contaminated exhaust from the production process in order to produce the necessary thermal energy required by the individual process steps during the production of the products above. For this purpose, usually thermal oil is heated or steam is generated. A large quantity of materials that cannot be used directly or waste occurs, especially in the manufacturing of chipboard or during decortication of tree trunks in the course of MDF manufacturing and these are usually sent for thermal recycling. This includes, for example, bark, off-spec material, defective yield, scrap material, low-quality fuels, scrap wood, grinding dust, etc.

For this purpose, the energy production systems usually comprise an air-cooled incineration grate (moving grate) in an incineration chamber, which generally supplies the material to be incinerated using a step-like combustion surface. The combustion surface here consists of grate bars arranged next to each other over the width and over each other in step shape over the length. The fuel is placed on the top of an incineration grate forming a step and it is conveyed to the combustion surface below by levels of the step that can be moved at regular intervals. In this case, the combustion surface is provided from below with primary air for cooling the grate bars and for supplying the incineration chamber with oxygen. The primary air passes between the grate bars and into the incineration chamber. At the end of the step-shaped combustion surface, the incinerated fuel is discarded as ash and carried away by a wet ash removal system. During the incineration of the fuel, high temperatures occur, preferably just up to 1000° C., so heat-resistant stainless steel castings are used for grate bars. Still these grate bars are subject to tribological wear due to thermal and mechanical stress and must occasionally be replaced.

The grate bars necessary for forming an incineration grate generally have geometric characteristics that are subject to a function-related necessity, but also manufacturing-related necessities.

In order to give uniform specifications in the following statements, the following assumptions are made with respect to the geometry and the arrangement of the grate bar within an incineration chamber for construction of a combustion surface on an incineration grate:

A grate bar essentially comprises an upper side turned toward the incineration chamber; a lower side turns toward at least one (possibly movable) support. Over their width, several grate bars arranged next to each other form a stair step, whereby the longitudinal extension of the grate bars is arranged in conveyor direction of the fuel and the possibly-moving support. The surface of one grate bar that essentially connects the combustion surfaces facing upward of two grate bars, in this case is defined as a thrust or connecting surface, since usually each second stair step of the incineration grate is designed so it is movable and thus causes a conveyance and mixture of the fuel during the incineration. Thus in their width and their length, the grate bars form the combustion surface and in their height form the stair steps of an incineration grate, and respectively the distance between the combustion surfaces of two stair steps. To summarize the geometry of a grate bar, the upper side of the grate bar is the supporting surface for the fuel, the back side forms the side with a support for a stationary or movable grate rod; the front side forms the generally slightly rounded connecting surface from the upper supporting surface to the underside of the grate bar, whereby the underside of the grate bar is blasted with the cooling primary air. The front side, i.e. the connecting surface, can be designed in many different geometries. The required overlap between the grate bars will prevent ash and fuel from dropping through between the grate bars and generally is produced by a rib on one grate bar and a part of the supporting surface of an adjacent grate bar lying above it. Within the gap, i.e. the groove that occurs due to the overlap, clearances arranged that provide for the necessary distance vertically and horizontally for ventilation of the fuel with primary air. The longitudinal center plane is arranged from top to bottom and in longitudinal extension from front to rear.

From known embodiments of incineration grates of this type, overlapping the combustion-side surfaces of the grate bars with respect to the adjacent grate bar in order to obtain a form-fitting connection is known. However, this results in the disadvantage that during replacement of one grate bar in a row (stair step), almost all grate bars have to be removed until the damaged grate bar is reached in order to replace it. Because of the asymmetrical design and introduction of force into the grate bar, it is also exposed to increase wear in the suggested embodiment. If an asymmetrical design of the grate bar is omitted, the result is that in longitudinal direction (along the steps), the grate bars lift up from each other in the course of the pushing work and fuel gets between the grate bars even gets into the area of the primary air supply. Here as well, elevated wear, local overheating problems in the incineration grate and other difficulties occur, which could even trigger an emergency shut-off of the incineration chamber. This circumstance is usually corrected in that several grate bars are combined using threaded rods to form a package. Because of the higher inherent weight of several grate bars, the bar lifting up is actually prevented, but the working and manufacturing effort for the precautions is considerable concerning the placement of suitable holes (undercuts) in the casting die and the assembly of the threaded rods. Also, several connected grate bars can be difficult to handle and stress the installers excessively. The fact that during a replacement of a grate bar, the entire grate bar set is taken out, disassembled and has to be replaced again after being provided with the new replacement parts increases the difficulty. Generally a further increase of working effort or mechanical aids (lifts, cranes) is inevitable. Here it is also possible that, in order to be able to replace a defective grate bar, a complete grate bar series has to be removed for replacement of a single grate bar.

The object of the invention now consists of producing an incineration grate consisting of a number of grate bars that makes possible a simple replacement of individual grate bars and simultaneously provides for a maximum degree of operating safety. In addition, the most geometrically simple system possible of easily removable grate bars without undercuts must be ensured in order to optimize the manufacturing costs of the grate bars and thus to optimize the incineration grate. Ultimately, a method will be produced for installation and removal of individual grate bars in an incineration grate that has grate bars according to the invention.

The object of producing an incineration grate consists of the characteristics of independent Claim 1.

The solution for a method for installation and removal consists in the characterizing features of Claim 9:

Method for installing and removing grate bars into and from an incineration grate with a number of grate bars that are arranged in rows next to each other and in rows under each other and form step-shaped combustion surfaces with their upper supporting surfaces, wherein a step-shaped combustion surface is formed over the width of the incineration grate of several first and second grate bars A, B that are mounted on one side on a grate rod with a support, wherein the first grate bars A, over their width b, at least once in the area of the supporting surface, a supporting surface smaller than that of the second grate bars B is formed for the fuel due to a shoulder toward the inside in the direction of the longitudinal center plane and wherein, over their width b, the second grate bars B have a supporting surface with larger width b' due to a shoulder toward the outside for forming an overlap with the first grate bars A, whereby adjacent to and/or bordering the connecting surfaces, the second grate bars B have a pin that can be introduced into a corresponding pocket of the first grate bars A, which additionally increases the width b' to a width b", whereby for removal, a second grate bar B on the side of the support can be lifted far enough from the grate bar so that it can be slid along the longitudinal center plane in order to remove the pin from the pocket of the adjacent grate bars A, whereby the reverse sequence is used for installation of the second grate bar B.

In an advantageous manner, the grate bars that preferably and essentially consist of at least two different geometries are nested on each other with form fit in such a way that in normal operation they do not have a tendency to lift up from the level of the grate bars lying under below them. In particular, this should not occur in pushing operation when each, or only every xth, row of grate bars is slid during the incineration process in order to optimize the incineration of the fuel.

In addition, it will be possible to dispense with additional components like screws, nuts, bolts, threaded rods, etc., for one thing, in order to save material and assembly costs and, for another, in order to clearly speed up and simplify the installation and removal of the grate bars. Since the grate bars will usually be manufactured of expensive cast stainless steel, the grate bars will have no undercuts and can be removed from the die in two directions. Because of this, the casting die will also be greatly simplified and the manufacturing costs of the grate bars will be lowered.

In this process, the grate bars will be set up in such a way that in installed state, one first grate bar A is held by two adjacently mounted grate bars B (left and right) having a second geometry deviating from that of first grate bar A. This is made possible in that preferably the two variants of the grate bars essentially have the same width b, but due to a shoulder inward of the supporting surface for the fuel, the first grate bar A has a width essentially equal to the second grate bar B with a corresponding opposite shoulder (involving widening of the supporting surface for the fuel), to restrict its freedom of movement upward in the direction of the incineration chamber by the overlapping of the first grate bar that occurs. In longitudinal extension, all grate bars are essentially fastened by a grate rod and a support suitable for this on the grate bars.

Thus the first grate bar A is held with form fit in this system of two grate bars and cannot slide in operation.

The second grate bars B could fairly relatively shift upward from their position in operation if these did not additionally have a pin or a tab engaging in the adjacent first grate bars A. Preferably, this pin is amounted opposite the support for the grate rod, especially preferably in the area of the connecting surface of two different grate levels, i.e., of different grate bars. Because of the arrangement of the pin and, preferably pockets corresponding to it, in the adjacent grate bars, the second grate bars B with the wide supporting surfaces for the fuel prevents the possibility of lifting upward. Because of the pins, the adjacent and form-fitting grate bars that are also connected would also have to lift up. The opposite sides of the grate bars that have the supports and are connected with form fit to the grate rod, will be held tightly by the weight of the grate bars of the next higher level/step lying over them.

It is understandable that the pocket, and respectively the pin, can have other possible geometries, but must be arranged so that the grate bar with the pin projecting outward (essentially parallel to the width of the combustion grate) cannot be shifted upward.

To do this, the pocket or the engagement of the pin in the adjacent grate r should have no direct opening upward in the direction of the fuel.

However, in order to now install or remove different grate bars, it is necessary that the pocket, i.e., the access option for the pin of grate bar B in grate bar A, forms or makes possible an opening or freedom of movement toward the front.

This is connected with the fact that for removal of the grate bars, any second grate bar B can be lifted on one side from the grate bar of the thrust bearing at its support (rear), while the other side (front) with the pin remains in engagement with the corresponding pocket. Thus the pin essentially assumes the function of a rotary joint. If the rear part of the grate bar (the support) is no longer in engagement with the grate rod, the grate rods can be moved forward. In this case, the pin slides out of the pocket and the grate bar can be removed. In each case, adjacent grate bars must only be slid over their widths in order to also slide them out of the area of the overlap (rib/supporting surface) and then they can also be removed. Thus it is possible in a simple way to remove any grate bar from the incineration grate without the inconvenience of lifting up several connected grate bars or removing an entire row of grate bars. It is understandable that the upper row of grate bars that lie with their front ends (connecting surfaces) on the grate bars have to be lifted up before the removal of a grate bar. This can easily be done with wedges or other lifting tools.

In summary, it can be stated that grate bars A and B should be designed essentially symmetrically. In this case, in the lower area (right and left), grate bar A has a recess (pocket). In contrast to this, in the front area (right and left), grate bar B has a pin (tab). Because of the fact that the grate bars have shoulders in the upper area, grate bar A inward and grate bar B outward, when the grate bars are combined to form a grate bar row, a form-fitting connection occurs without additional components. Thus it is ensured that an individual grate bar can never lift up during operation. Because of the fact that the pocket and/or the tab is located immediately in the area of the parting plane of the cast part, no undercut thus occurs.

The removal from the casting die can occur in two directions and the tooling costs thus remain low. In this type of embodiment, special sliders can be dispensed with. For removal of an individual grate bar (during maintenance or spare parts work), only grate bar B needs to be lifted a short distance (about 7°) in the rear area. Then the grate bar can be slid out, without impediments, to the front in the direction of the connecting surface.

Other advantageous measures and designs of the object of the invention are seen from the subclaims and from the following description of a preferred exemplary embodiment with the drawing. It should be emphasized that characteristics listed in the following are understood not only in combination, but also as independent individual characteristics in the sense of the invention.

Figure 2:
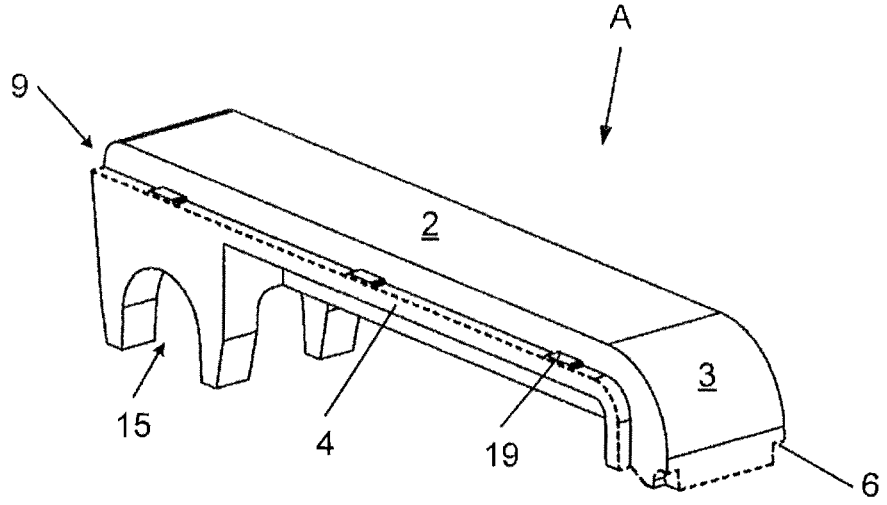
Figure 3:
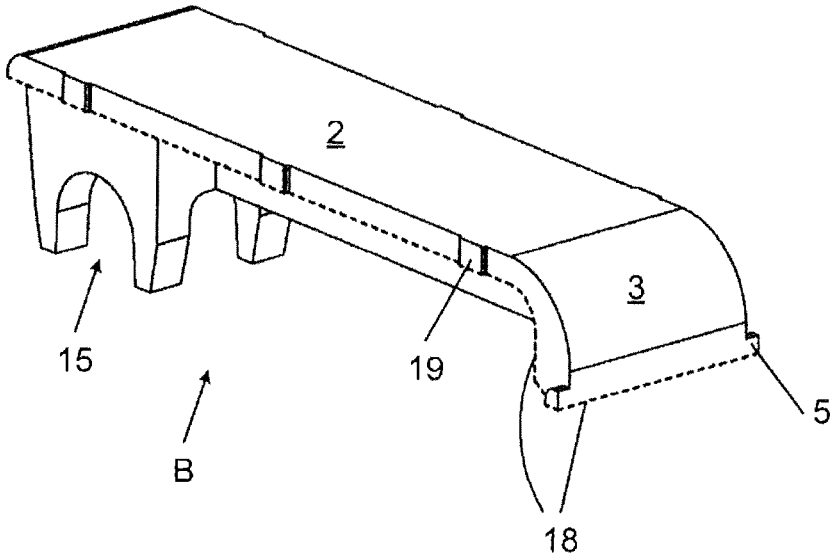
Figure 4:
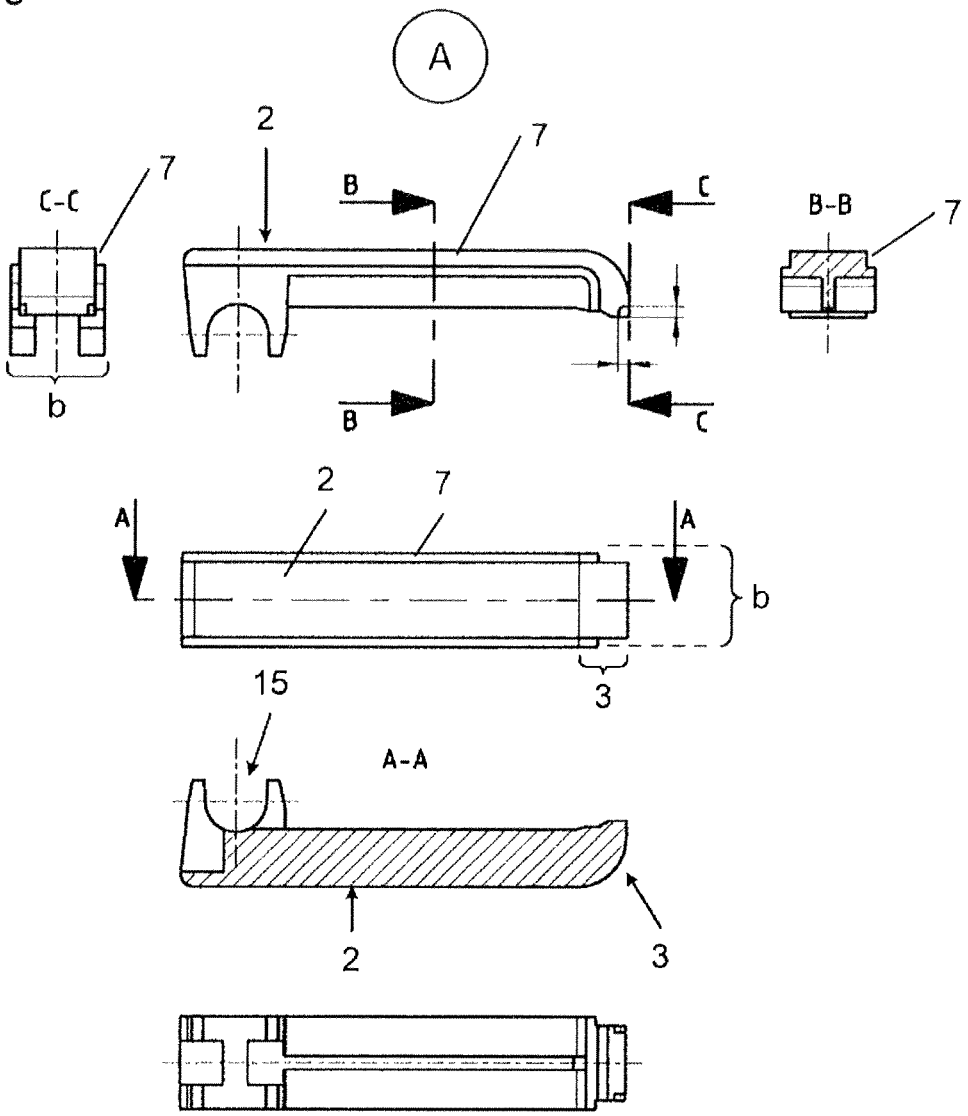
Figure 5:
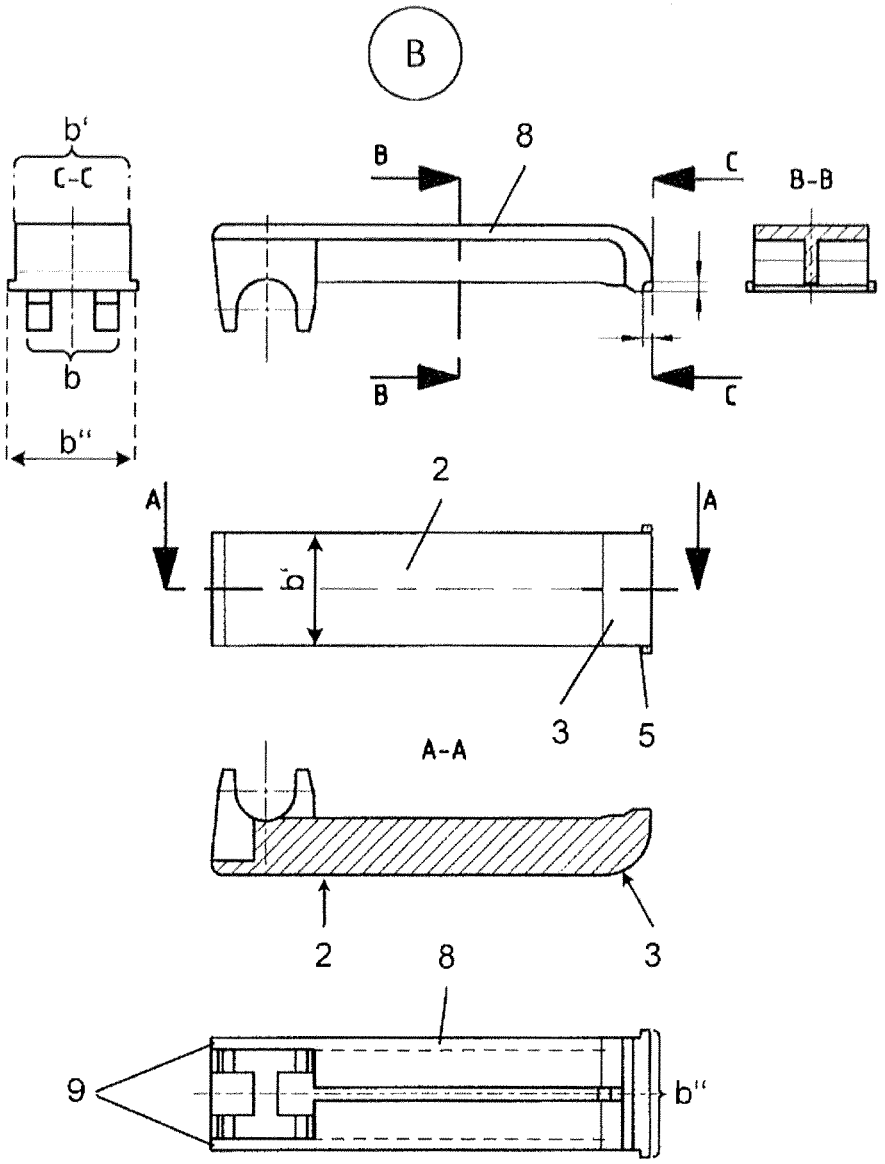
Figure 6:
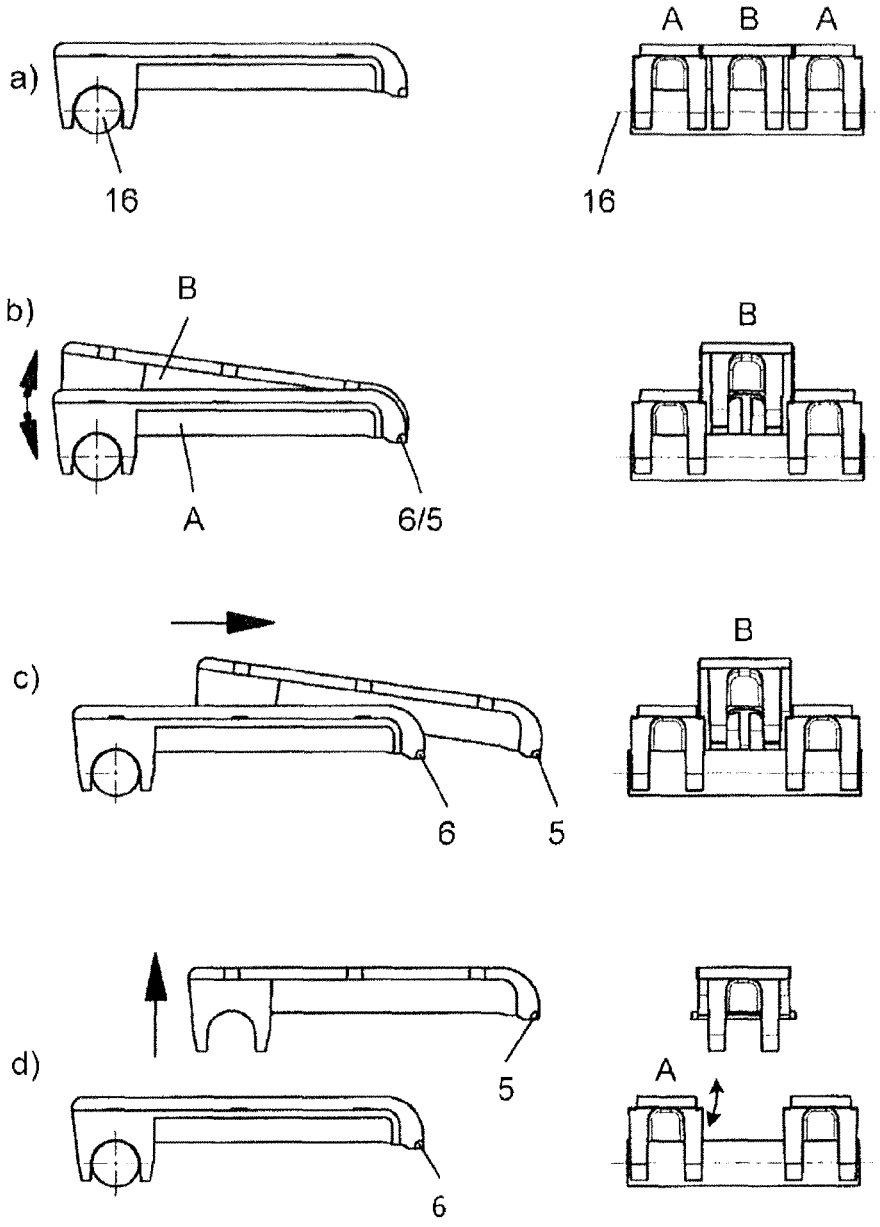
Figure 7:
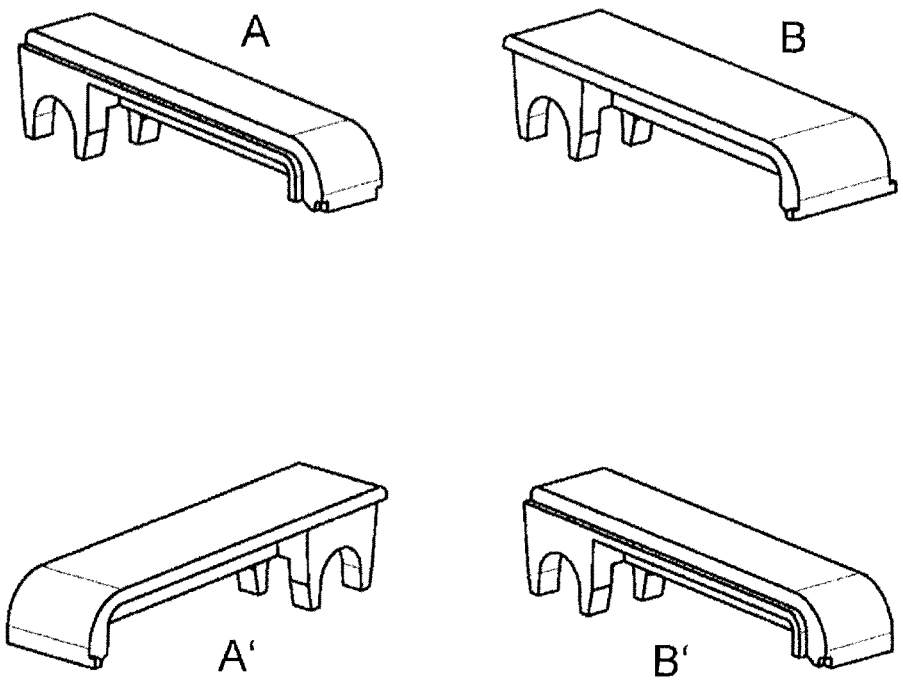

In the drawings:

FIG. 1 shows, in two schematic side views, partial cutouts of a step-shaped incineration grate with grate bars arranged in steps, whereby the alternating rows of the grate bars are connected with a fixed bearing and a movable thrust bearing, FIG. 2 shows a three-dimensional view of a first grate bar A with a width of its supporting surface for the fuel that is smaller in comparison to its normal width b and the formation of a rib and two pockets, FIG. 3 shows, in a three-dimensional comparison, a second grate bar B with a width of its supporting surface for the fuel that is larger than its normal width b for overlapping with a first grate bar A, FIG. 4 shows the grate bar A according to FIG. 2 in several cross section views, FIG. 5 shows the grate bar B according to FIG. 3 in several cross section views, FIG. 6 shows the method for removing a second grate bar B from a completely assembled row of grate bars and FIG. 7 shows a 3-D view of the at least four necessary grate bars A, B, A' and B' for producing a complete incineration grate.

According to FIG. 1, an incineration grate 11 consists of several steps of a number of grate bars 1 that are arranged in rows next to each other and in rows under each other and that form combustion surfaces for the fuel 14 with their upper supporting surfaces 2. In this case, a grate bar 1 has a rear end with a support 15 for form-fitting connection with a grate rod 16 and a front end with a connecting surface 3 between the upper supporting surface 2 and the lower contact surface of grate bar 1 with the grate bar 1 of the next lower level. These step-shaped combustion surfaces 17 are formed over the width of the incineration grate 11 of first and second grate bars A, B, preferably in alternating sequence, whereby on the respective end of the combustion surface 17, special grate bars A'/B' (FIG. 7) can be arranged. The connecting surface 3 can be designed in a number of geometries, but essentially the supporting surface 2 of a grate bar A, B is connected to the supporting surface 2 of another grate bar A, B with form fit, in such a way that during sliding, the fuel 14 can fall onto the grate bars 1 arranged one step further below. In higher-quality incineration grates 11, each second step is generally designed by means of a fixed bearing 12 and each second step offset to it for moving a step of the incineration grate is designed using a thrust hearing. FIG. 2 now shows a first grate bar A with a smaller supporting surface for the fuel 14 than grate B according to FIG. 3. In the rear area, both grate bars A, B, have a support 15 for form-fitting connection with grate rod 16 and in the front area, the supporting surface 2 changes into a connecting surface 3 that essentially ends on the underside of grate bar A, B ends when it makes contact with the supporting surface 2 of the next grate bar A or B. The transition between the supporting surface 2 and the connecting surface 3 is generally flowing and depends on the fuel 14 to be incinerated. If the two grate bars A, B are now arranged next to each other on a grate rod 16, the result is an overlap 9 by which the rib 4 of the first grate bar A is located below the supporting surface 2 of the second grate bar B. Thus, with a simultaneous form-fitting position of the support 15 on a grate rod 16, when an overlap is formed, it is no longer possible for a grate bar A that lies between two grate bars B to lift up. The spacer 19 of the two grate bars A and B provide for the necessary spacing of the grate bars A, B vertically and horizontally in order to be able to supply adequate primary air for cooling the grate bars and for firing the fuel.

According to FIGS. 4 and 5, over their width b, the first gate bars A have at least one shoulder 7 toward the inside in the area of the supporting surface to form a supporting surface 2 for the fuel smaller than that on the second grate bars B, whereby the second grate bars B have a supporting surface 2 with larger width b' due to a shoulder 8 outward, for forming an overlap 9 with the first grate bar A. In order to also obtain a form-fitting connection for fastening the grate bars B in installed state, adjacent to and/or bordering the connecting surfaces 3, the grate bars have at least one pin 5 that additionally enlarges a width b' to width b", preferably on both sides, the pin engaging in a corresponding pocket 6 of the adjacent first grate bars A. Accordingly, the second grate bar B that is fixed with form fit due to the pin 5 fastened in the pockets 6 can no longer be lifted without also lifting the adjacent grate bars A. Preferably it is provided that the cross section of the grate bars A, B is essentially similar or equal outside the area of the shoulders. Preferably the grate bars A, B should essentially have the same width b so that in the design of the shoulders, essentially equal dimensions result. Preferably it is especially provided that each supporting surface 2, the shoulders 7, 8, the overlaps 9 of the grate bars A, B, the ribs 4, the pockets 6 and/or the pins 5 are designed symmetrically from top to bottom and in longitudinal plane 10 running in a longitudinal direction of grate bars A, B.

Preferably the pocket 6 should be arranged at a distance from the supporting surface 2.

It is especially advantageous if the pockets 6 and/or the pins 5 are arranged adjacent to the die removal plane 18 or cut from it. The die removal plane 18 is shown there in dotted lines and indicates the plane from which the grate bar 1 can be removed from the die on two sides after the casting. This is especially advantageous to prevent unnecessary undercuts that were previously usual according to the state of the art. It is understandable that the pockets 6 and/or the pins 5 cannot be arranged in such a way that they are wide open in the direction of the supporting surface 2, since otherwise no form-fitting connection can be implemented that can prevent the unintended lifting of the grate bars 1 from the grate bars lying below.

Preferably the first grate bars A will have a rib 4 that is arranged below the shoulder 8 in the area of the supporting surface 2 for overlapping 9 with the second grate bars B.

FIG. 6 now shows the sequence of a method for removing a grate bar B from a form-fitting connection between two grate bars A. In this case, grate bar B can be lifted upward at its rear support and thereby turns around the auxiliary bearing consisting of the pins 5 of the grate bar B and the associated pockets 6 of the adjacent grate bars A. After adequate lifting of the rear side of the grate bar B, the support 15 of grate bar B is no longer in engagement with grate rod 16, so grate bar B can be slid forward and the pins of grate bar B can leave the pockets 6 of the adjacent grate bars A.

Now gate bar B can be removed without problems. In order to now remove the adjacent grate bar B, it only needs to be slid somewhat in the direction of the gap of the grate bar that was already removed that has become fee in order to release the form-fitting overlap 9 with the additional grate bar B. The installation and mounting of grate bars A, B occurs essentially analogously and in reverse sequence.

Now for the sake of completeness, FIG. 7 shows a complete set of grate bars necessary for optimal production of an incineration grate. Depending on the requirements, it may be sufficient to arrange all grate bars in the same alignment. It can also be desirable to arrange these offset to each other in steps. In this context it may also make sense to produce grate bars A', B' for the edge area. Alternatively, the walls lying on the outside and adjacent to the combustion surfaces 17 could simulate geometric edges and/or surfaces in order to achieve a form-fitting connection of the grate bars A, B with the walls.

REFERENCE NUMBER LIST: P1427

1. Grate bar
2. Supporting surfaces
3. Connecting surface
4. Rib
5. Pin
6. Pocket
7. Shoulder, inner
8. Shoulder, outer
9. Overlap
10. Longitudinal center plane
11. Incineration grate
12. Fixed bearing
13. Thrust bearing
14. Fuel
15. Support
16. Grate rod
b Normal width without shoulders
b' Shoulder toward the outside
b" Width of the tab/pin 5

The invention claimed is:

1. An incineration grate including several levels, the incineration grate comprising a plurality of grate bars arranged in rows alongside one another and in rows one above another, the grate bars forming step-shaped combustion surfaces with upper supporting surfaces thereof, the grate bars including first grate bars and second grate bars, wherein a step-shaped combustion surface is formed over a width of the incineration grate from several first grate bars and second grate bars, wherein connecting surfaces are arranged on the grate bars, the connecting surfaces configured to compensate for a difference in height between two adjacent combustion surfaces of the grate bars, wherein at least once in an area of the upper supporting surfaces, the first grate bars form a supporting surface for fuel over their width that is smaller than that of the second grate bars via a first shoulder disposed inwards in a direction of a longitudinal center plane, wherein in an area of the upper supporting surfaces, the second grate bars have a supporting surface with a larger width in order to form an overlap with the first grate bars via a second shoulder disposed outwards over the width of the first grate bars, wherein adjacent to and/or bordering the connecting surfaces, only the second grate bars comprise at least one pin configured to further increase the larger width, the pin configured to be introduced into a corresponding pocket in the first grate bars, and wherein the pin comprises a projection that projects outward from a surface of a respective second grate bar.

2. The incineration grate according to claim 1, wherein cross sections of the first and second grate bars excluding the first and second shoulders are substantially equal and have a T-shaped profile.

3. The incineration grate according to claim 1, wherein cross sections of the first and second grate bars excluding the first and second shoulders are substantially equal and have a T-shaped profile, and wherein the first and second grate bars have a substantially same width.

4. The incineration grate according to claim 1, wherein the first and second grate bars have a substantially same width.

5. The incineration grate according to claim 1, wherein the pocket is arranged at a distance from the upper supporting surface.

6. The incineration grate according to claim 1, wherein the pocket, the at least one pin, or a combination thereof is arranged adjacent to or bordering a die removal plane or the connecting surfaces, or is intersected by the die removal plane or the connecting surfaces.

7. The incineration grate according to claim 1, wherein in the area of the upper supporting surfaces, the first grate bars have a rib that is arranged below the second shoulder to form the overlap of the first and second grate bars.

8. The incineration grate according to claim 7, wherein the upper supporting surfaces, the first and second shoulders, the overlap of the first and second grate bars, the rib, the pocket, the at least one pin, or a combination thereof are formed symmetrically with respect to the longitudinal center plane running from top to bottom and in a longitudinal direction of the grate bars.

9. The incineration grate according to claim 1, wherein spacers are arranged on adjacent contact surfaces between the first and second grate bars.

10. The incineration grate according to claim 1, wherein each of the first grate bars and the second grate bars include a support at a rear end thereof, the support configured for a form-fitting connection with a grate rod, and a connecting surface of each of the first grate bars and the second grate bars is located at a front end thereof.

11. A method for installing and removing grate bars into and from an incineration grate comprising a plurality of grate bars arranged in rows alongside one another and in rows one above another, the grate bars including first grate bars and second grate bars having upper supporting surfaces and adjacent connecting surfaces, the method comprising:

forming a step-shaped combustion surface over a width of the incineration grate using the upper supporting surfaces of the first grate bars and second grate bars, which are mounted on one side with a support on a grate rod, wherein, at least once, over their width, the first grate bars form a supporting surface for fuel that is smaller than that of the second grate bars via a first shoulder disposed inwards in a direction of a longitudinal center plane, and wherein, in an area of the upper supporting surfaces, the second grate bars have a supporting surface with a larger width in order to form an overlap with the first grate bars via a second shoulder disposed outwards over the width of the first grate bars, wherein adjacent to and/or bordering the connecting surfaces, only the second grate bars comprise at least one pin configured to further increase the larger width, the pin configured to be introduced into a corresponding pocket in the first grate bars, wherein the pin comprises a projection that projects outward from a surface of a respective second grate bar, wherein for removal, a second grate bar on a side of the support is lifted from the grate rod far enough so that the second grate bar can be slid along the longitudinal center plane in order to remove the pin from the pocket of adjacent first grate bars, and wherein a reverse sequence is used for installing the second grate bar.

12. The method according to claim 11, wherein the support of each of the first grate bars and the second grate bars is located at a rear end thereof, and a connecting surface of each of the first grate bars and the second grate bars is located at a front end thereof.

* * * * *